US008672730B2

(12) United States Patent
McAllister

(10) Patent No.: US 8,672,730 B2
(45) Date of Patent: Mar. 18, 2014

(54) METHOD AND APPARATUS FOR POLISHING AND GRINDING A RADIUS SURFACE ON THE AXIAL END OF A CYLINDER

(75) Inventor: W. Elliot McAllister, Christiansburg, VA (US)

(73) Assignee: Exelis, Inc., McLean, VA (US)

( * ) Notice: Subject to any disclaimer, the term of this patent is extended or adjusted under 35 U.S.C. 154(b) by 525 days.

(21) Appl. No.: 12/977,688

(22) Filed: Dec. 23, 2010

(65) Prior Publication Data

US 2012/0164921 A1 Jun. 28, 2012

(51) Int. Cl.
*B24B 1/00* (2006.01)

(52) U.S. Cl.
USPC ..... 451/42; 451/265; 451/287; 451/289

(58) Field of Classification Search
USPC ..... 451/42, 43, 285–290
See application file for complete search history.

(56) References Cited

U.S. PATENT DOCUMENTS

| | | | | |
|---|---|---|---|---|
| 2,919,523 | A * | 1/1960 | Phillips et al. | 451/42 |
| 3,117,396 | A * | 1/1964 | Dalton | 451/42 |
| 3,492,764 | A * | 2/1970 | Dalton | 451/42 |
| 4,768,308 | A * | 9/1988 | Atkinson et al. | 451/5 |
| 4,850,152 | A * | 7/1989 | Heynacher et al. | 451/5 |
| 4,908,997 | A | 3/1990 | Field, Jr. et al. | |
| 4,956,944 | A * | 9/1990 | Ando et al. | 451/5 |
| 4,979,334 | A | 12/1990 | Takahashi | |
| 5,140,777 | A * | 8/1992 | Ushiyama et al. | 451/5 |
| 5,516,328 | A | 5/1996 | Kawada | |
| 6,280,293 | B1 | 8/2001 | Minami et al. | |
| 6,855,036 | B1 * | 2/2005 | Arserio et al. | 451/42 |
| 7,210,983 | B1 | 5/2007 | Chien | |
| 7,364,493 | B1 | 4/2008 | Strafford et al. | |
| 2003/0036342 | A1 | 2/2003 | Yamada et al. | |
| 2003/0043343 | A1 * | 3/2003 | Diehl et al. | 351/177 |

FOREIGN PATENT DOCUMENTS

| | | |
|---|---|---|
| EP | 0868972 | 10/1998 |
| JP | 2001 162533 | 6/2001 |

OTHER PUBLICATIONS

International Search Report of PCT/US2011/066056, EPO Authorized Officer, Dupont-Hüper, Marie-Laure; Jun. 20, 2012.

* cited by examiner

*Primary Examiner* — Maurina Rachuba
(74) *Attorney, Agent, or Firm* — RatnerPrestia

(57) ABSTRACT

An apparatus and a method for forming or polishing a concave or convex radius surface on a work-piece is described herein. The apparatus includes a carrier that is configured to support a work-piece. A substantially hollow rotatable tool, which includes a circumferential surface for either forming or polishing the radius surface, is positioned adjacent the carrier. An axis of rotation of the tool is oriented at an oblique angle with respect to a longitudinal axis of the work-piece and a longitudinal axis of the carrier. Alternatively, the longitudinal axis of the work-piece may be laterally offset from the longitudinal axis of the carrier. The apparatus further includes provisions for rotating the hollow rotatable tool for forming or polishing a radius surface on the surface of the work-piece.

7 Claims, 6 Drawing Sheets

METHOD AND APPARATUS FOR POLISHING AND GRINDING A RADIUS SURFACE ON THE AXIAL END OF A CYLINDER

FIELD OF THE INVENTION

The present invention relates, in general, to a system for polishing and grinding. More specifically, the present invention relates to a system for polishing and grinding a radius surface on the axial end of a cylinder.

BACKGROUND OF THE INVENTION

A goal of grinding and polishing a work-piece is to produce a surface that meets a set of predetermined specifications typically related to a desired finish and shape. The processes of grinding and polishing a work-piece typically involve relative motion between a polishing/grinding tool and the work-piece. This may be accomplished in a number of ways, frequently involving at least one of controlled relative rotation and translation between the work-piece and the polishing/grinding tool.

SUMMARY OF THE INVENTION

According to one aspect of the invention, an apparatus for forming or polishing a concave or convex radius surface on a work-piece is provided. The apparatus comprises a carrier that is configured to support a work-piece. A substantially hollow rotatable tool, which includes a circumferential surface, is positioned adjacent the carrier. An axis of rotation of the tool is oriented at an oblique angle with respect to a longitudinal axis of the work-piece and a longitudinal axis of the carrier. The apparatus further comprises a means for rotating the hollow rotatable tool for forming or polishing a radius surface on the surface of the work-piece.

According to another aspect of the invention, a machine for simultaneously forming a concave or convex radius surface on a plurality of work-pieces comprises a first platform including a plurality of work-piece receiving areas that are each configured to accommodate a work-piece, and a means for rotating each of the work-pieces within their respective work-piece receiving areas. A second platform is positioned adjacent the first platform. The second platform includes a plurality of substantially hollow rotatable tools each of which include a circumferential surface that is configured for forming or polishing a radius surface on a work-piece. Each hollow rotatable tool corresponds in position to a work-piece receiving area of the first platform. The second platform also including a means for rotating each of the hollow rotatable tools. An axis of rotation of each tool is oriented at an oblique angle with respect to a longitudinal axis of a corresponding work-piece and a longitudinal axis of a corresponding work-piece receiving area.

According to yet another aspect of the invention, a method of forming a concave or convex radius surface on a work-piece comprises the steps of: (a) positioning a work-piece in or on a carrier; (b) positioning an abrasive surface of a substantially hollow rotatable tool adjacent the work-piece such that an axis of rotation of the tool is oriented at an oblique angle with respect to a longitudinal axis of the work-piece and a longitudinal axis of the carrier; (c) rotating the hollow rotatable tool in a first direction; and (d) rotating the carrier in a direction that is opposite the first direction to form a radius surface on the work-piece.

According to still another aspect of the invention, an apparatus for forming or polishing a beveled surface on a work-piece comprises a carrier that is configured to support a work-piece. A substantially hollow rotatable tool is positioned adjacent the carrier. The substantially hollow rotatable tool includes a circumferential surface for either forming or polishing the beveled surface. An axis of rotation of the tool is laterally offset from a longitudinal axis of the work-piece and a longitudinal axis of the carrier. A means for rotating the hollow rotatable tool is provided for forming or polishing the beveled surface on the surface of the work-piece.

BRIEF DESCRIPTION OF THE DRAWINGS

The invention is best understood from the following detailed description when read in connection with the accompanying drawings. Included in the drawings are the following figures.

DETAILED DESCRIPTION OF THE INVENTION

Figure 1C:
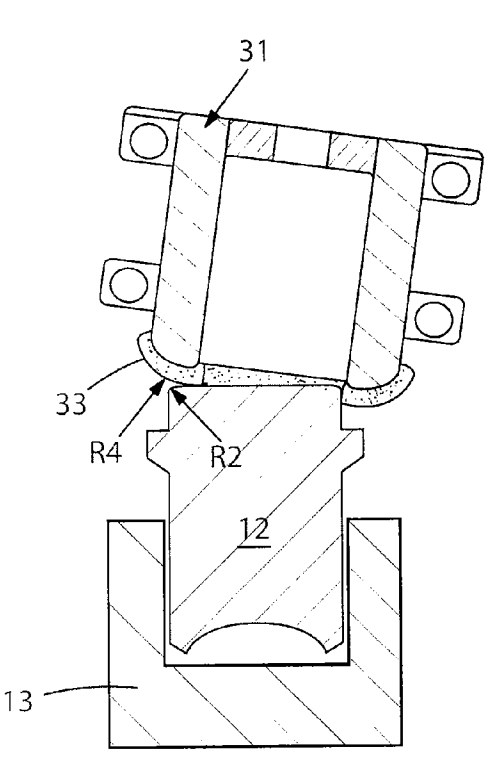
FIG. 1C is a cross-sectional view of yet another polishing tool applied to a surface of a work-piece that is supported in a carrier, according to a third exemplary embodiment of the invention.
Figure 1B:
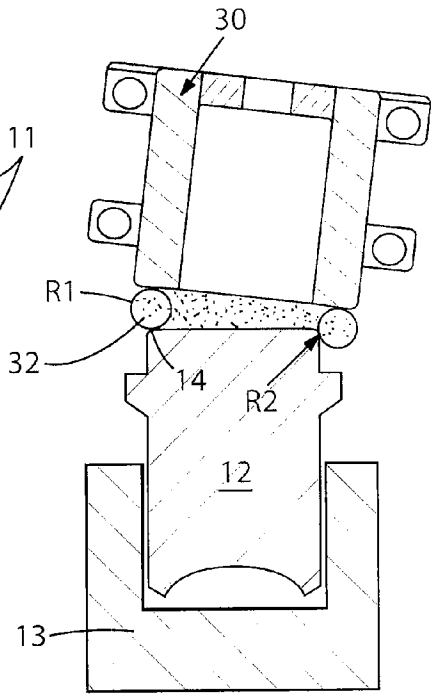
FIG. 1B is a cross-sectional view of another polishing tool applied to a surface of a work-piece that is supported in a carrier, according to a second exemplary embodiment of the invention.
Figure 1A:
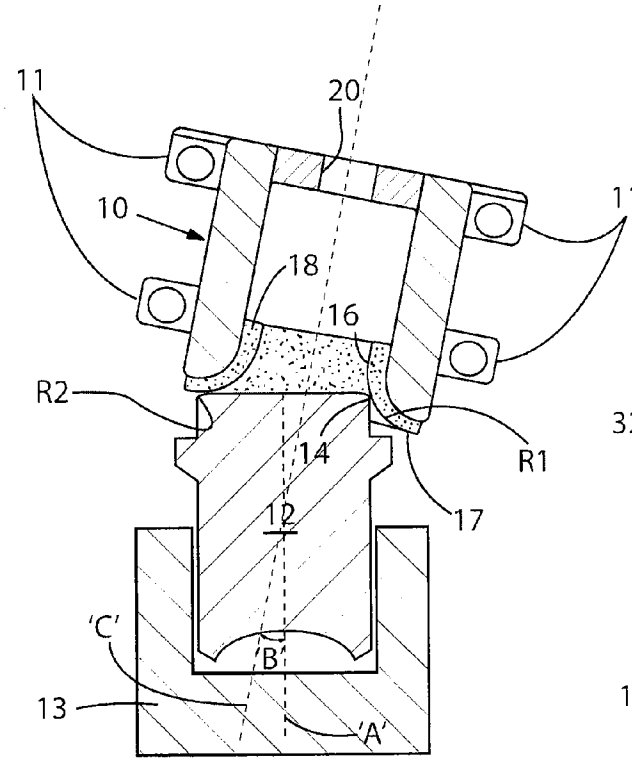
FIG. 1A is a cross-sectional view of a polishing tool applied to a surface of a work-piece that is supported in a carrier, according to a first exemplary embodiment of the invention.

FIG. 1A is a cross-sectional view of a rotatable polishing/grinding tool 10 applied to a surface of a work-piece 12 that is supported in a recess of a carrier 13, according to a first exemplary embodiment of the invention. The rotatable tool 10 is configured to create a rounded edge 14 on the axial end of a work-piece 12. By way of non-limiting example, the work-piece 12 is optionally an optic, such as a plano, spherical, aspheric, reflective or a refractive optic. Although not explicitly shown in the cross-sectional view of FIG. 1A (as well as FIGS. 1B-1D) it should be understood that the polishing/grinding tool 10, the work-piece 12 and the carrier 13 are substantially cylindrical components.

The tool 10 includes a disc-shaped base surface and a cylindrical wall extending from the disc-shaped base surface. The cylindrical wall extending from the disc-shaped base surface partially encloses a hollow interior region that extends between an open end and a closed end of the tool 10.

A series of bearings 11 are positioned on the exterior surface of the cylindrical wall to facilitate rotation of the tool 10 about its axis of rotation.

The disc-shaped base surface forms the closed end of the tool 10. An aperture 20 is defined on the disc-shaped base surface of the tool. In operation, fluid is delivered through the aperture 20 to the surface(s) of the work-piece undergoing machining, grinding or polishing. The fluid maintains the work-piece and the tool 10 at a stable temperature. Although not shown, another aperture may be defined on the cylindrical side wall of the tool through which the fluid is delivered and/or expelled.

A circumferential surface 16 is either defined on or extends from the open end of the tool 10. According to the exemplary embodiment of FIG. 1A, the circumferential surface 16 forms part of a polishing and/or grinding pad 18 that is adhered (or otherwise mounted) to the open end of the tool 10. According to one aspect of the invention, the pad 18 at least partially extends within the interior region of the tool 10. The circumferential surface 16 includes a rounded surface 17 having a predetermined radius 'R1.' The rounded surface 17 is configured to either grind or polish a surface on the axial end of the work-piece 12.

Figure 1D:
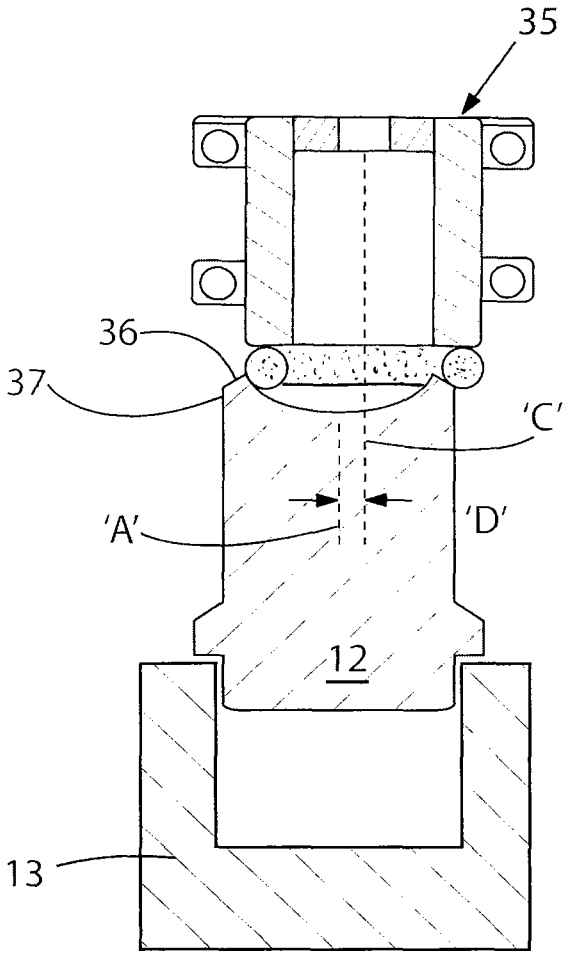
FIG. 1D is a cross-sectional view of yet another polishing tool applied to a surface of a work-piece that is supported in a carrier, according to a fourth exemplary embodiment of the invention.

The tool 10 is mounted such that an axis of rotation 'C' of the tool 10 is oriented at an oblique angle 'B' with respect to a longitudinal axis 'A' of the work-piece 12 and/or the carrier 13. Mounting of the tool 10 is described in greater detail with reference to FIG. 3. The oblique angle 'B' may be about 45 degrees, for example. According to one aspect of the invention, the oblique angle 'B' may be maintained at any angle between about 1 degree and about 89 degrees. Alternatively, the axis of rotation 'C' may be parallel to the longitudinal axis 'A', as shown in FIG. 1D By orienting the axis of rotation 'C' of the tool 10 at an oblique angle 'B' with respect to a longitudinal axis 'A' of the work-piece 12, the circumferential surface 16 of the pad 18 forms a rounded edge 14 on the axial end of the work-piece 12. The rounded edge 14 may be either concave or convex. The radius 'R2' of the rounded edge 14 that is formed on the work-piece 12 is dependent upon the angle 'B' and the radius 'R1' of the rounded surface 17 of the tool 10. Thus, the size of the radius 'R1' of the rounded surface 17 of the pad 18 and the oblique angle 'B' are pre-selected so as to form or polish a particular size radius 'R2' on the surface of the work-piece 12.

Although not explicitly shown in FIG. 1A, means are provided for rotating the tool 10. The tool 10 may be directly or indirectly rotated by a motor, a motor-driven belt, or a motor-driven gear, for example. Those skilled in the art will recognize that a variety of ways exist for rotating the tool 10 about its axis of rotation 'C.'

FIG. 1B is a cross-sectional view of another polishing/grinding tool 30 applied to a surface of a work-piece 12 that is supported in a carrier 13, according to a second exemplary embodiment of the invention. The tool 30 of FIG. 1B is substantially similar to the tool 10 of FIG. 1A, with the exception that the polishing and/or grinding pad 32 of the tool 30 has a circular cross-section. In other words, the pad 32 has an o-ring shape. The pad 32 is mounted to the free end of the cylindrical wall of the tool 30. The pad 32 may be adhered to the free end of the tool 30 by an adhesive, or, alternatively, the pad 32 may be mounted to the tool 30 by any other method that is known to those skilled in the art.

The size of the radius 'R2' of the rounded edge 14 of the work-piece 12 that is formed by the tool 30 is dependent upon the angle 'B' of the tool 30 and the cross-sectional radius 'R3' of the pad 32. Thus, the size of the radius 'R3' of the pad 32 and the oblique angle 'B' are pre-selected so as to form or polish a particular size radius 'R2' on the surface of the work-piece 12.

FIG. 1C is a cross-sectional view of yet another polishing/grinding tool 31 applied to a surface of a work-piece 12 that is supported in a carrier 13, according to a third exemplary embodiment of the invention. The tool 31 of FIG. 1C is substantially similar to the tool 10 of FIG. 1A, with the exception that the polishing and/or grinding pad 33 of the tool 31 extends around the exterior revolved surface of the tool 31.

The size of the radius 'R2' of the rounded edge 14 of the work-piece 12 that is formed by the tool 31 is dependent upon the angle 'B' of the tool 30 and the cross-sectional radius 'R4' of the pad 33. Thus, the size of the radius 'R4' of the pad 33 and the oblique angle 'B' are pre-selected so as to form or polish a particular size radius 'R2' on the surface of the work-piece 12.

FIG. 1D is a cross-sectional view of yet another polishing/grinding tool 35 applied to an opposing end 37 of work-piece 12 that is supported in a carrier 13, according to a fourth exemplary embodiment of the invention. The tool 35 is substantially similar to the tool 30 of FIG. 1B, however, unlike tool 30, the axis of rotation 'C' of tool 35 of FIG. 1D is not positioned at an oblique angle with respect to the longitudinal axis 'A' of work-piece 12. Rather, the axis of rotation 'C' of tool 35 of FIG. 1D is positioned parallel to the longitudinal axis 'A' of work-piece 12, and the axis of rotation 'C' of tool 35 is laterally offset from the longitudinal axis 'A' of work-piece 12 by a pre-determined distance 'D'. Laterally offsetting the axis of rotation 'C' of tool 35 from the longitudinal axis 'A' of work-piece 12, enables the tool 35 to form the beveled surface 36 on the opposing end 37 of work-piece 12.

The size of the radius 'R2' of the rounded edge 14 of the work-piece 12 that is formed by the tool 31 is dependent upon the angle 'B' of the tool 30 and the cross-sectional radius 'R4' of the pad 33. Thus, the size of the radius 'R4' of the pad 33 and the oblique angle 'B' are pre-selected so as to form or polish a particular size radius 'R2' on the surface of the work-piece 12.

Although not explicitly shown in FIGS. 1A-1D, means are provided for rotating the carrier 13. The carrier 13 may be directly or indirectly rotated by a motor, a motor-driven belt, or a motor-driven gear, for example. Those skilled in the art will recognize that a variety of ways exist for rotating the carrier 13 about its longitudinal axis 'A.' According to one aspect of the invention, the carrier 13 is rotated in a rotational direction that is opposite of the rotational direction of the tool 10. In other words, if the tool 10 rotates in a clockwise rotational direction, then the carrier 13 would rotate in a counter-clockwise direction, or vice versa. Alternatively, the carrier 13 may be fixed in position.

According to one aspect of the invention, the tool and the carrier 13 are mounted within a larger system. The system may comprise a single tool and a single carrier 13 for forming a radius surface on a single work-piece 12 (as shown in FIGS. 1A-1C). Alternatively, as described with reference to FIGS. 2-4B, the system may consist of a plurality of tools and a plurality of carriers, whereby each tool rotates in concert with a corresponding carrier to either form or polish a radius surface on the axial end of a work-piece 12.

Figure 2:
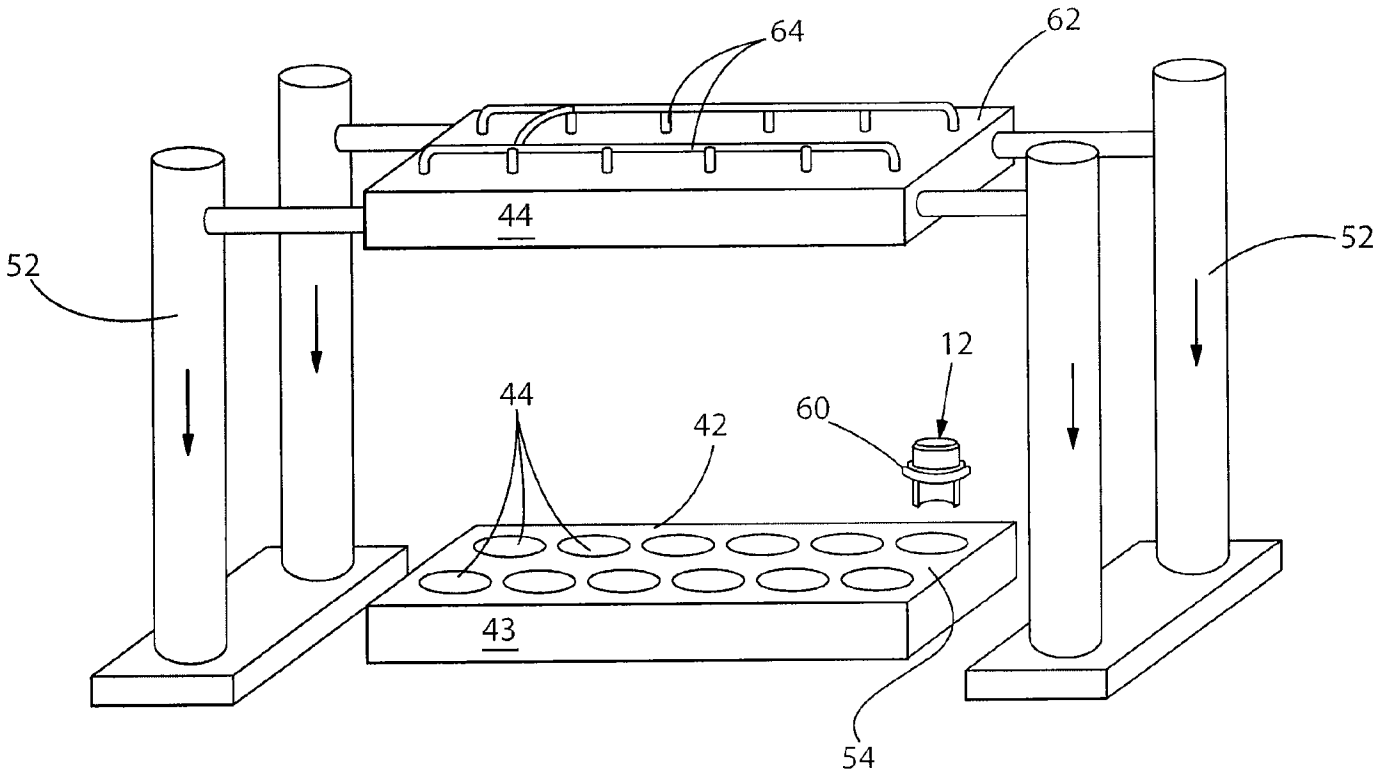
FIG. 2 is a partially exploded perspective view of a machine, shown schematically, for simultaneously polishing and/or grinding a plurality of work-pieces, according to an exemplary embodiment of the invention.
Figure 3:
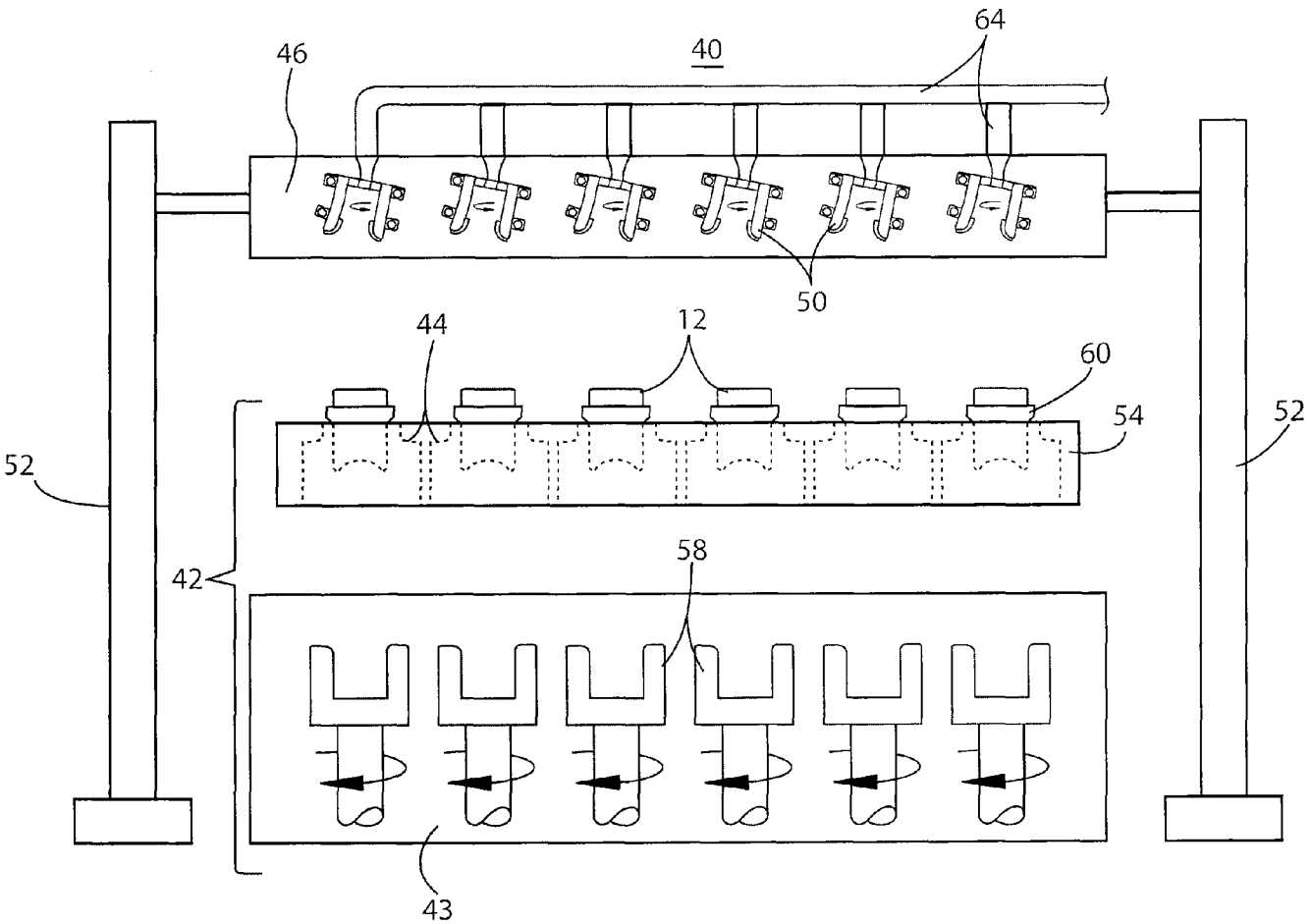
FIG. 3 is a side elevation view of the machine of FIG. 2 depicting the internal components of the machine.

FIG. 2 depicts a partially exploded perspective view of a machine 40 for simultaneously polishing and/or grinding the axial end of a plurality of work-pieces, shown schematically, according to an exemplary embodiment of the invention. FIG. 3 is an elevation view of the machine 40 of FIG. 2 depicting the internal components of to the machine 40.

The machine 40 includes a first platform 42 in which the work-pieces 12 are positioned and a second platform 46 in which a plurality of tools 50 are positioned. The second platform 46 is positioned above the first platform 42 on a press 52. The press 52 is configured to raise and lower the second platform 46 with respect to the first platform 42. The press 52 may be pneumatically or hydraulically actuated, for example. The press 52 and the first platform 42 may be mounted to a table, for example, or any other flat surface.

Referring now to the components of the first platform 42, the first platform 42 includes a housing 43, a removable tray 54 that is positioned on the top end of the housing 43 for accommodating a plurality of work-pieces 12, and means for rotating each of the work-pieces 12 about their respective longitudinal axes.

The removable tray 54 is shown separated from the housing 43 in FIG. 3. The tray 54 includes a plurality of work-piece receiving areas 44 that are each configured to accommodate a single work-piece 12, as shown. Each work-piece receiving area 44 corresponds in position to a tool 50 of the second platform 46 and a carrier 58. By way of non-limiting example, the tray 54 includes twelve work-piece receiving areas 44. According to another exemplary embodiment, the tray may be integrated with the housing 43.

The tray 54 includes a top surface, side surfaces and a series of through holes defined on the top surface. Each through-hole formed on the top surface of the tray 54 is sized to receive the lower end of a work-piece 12 and accommodate the cylindrical wall of the carrier 58. The flange 60 of each work-piece 12 is sized to rest on the top surface of the tray 54, as shown in FIG. 3. The tray 54 may be composed of plastic or metal, for example.

The first platform 42 also includes a plurality of rotatable carriers 58 that are each rotatably coupled to the housing 43. Each carrier 58 is analogous to the carrier 13 of FIGS. 1A and 1B. Each rotatable carrier 58 is positioned directly beneath a single work-piece 12. Each rotatable carrier 58 is configured to rotate that work-piece 12 while it is positioned in the tray 54. The first platform 42 also includes means for rotating each of the carriers 58, as will be discussed in greater detail with reference to FIGS. 4A and 4B.

Figure 4A:
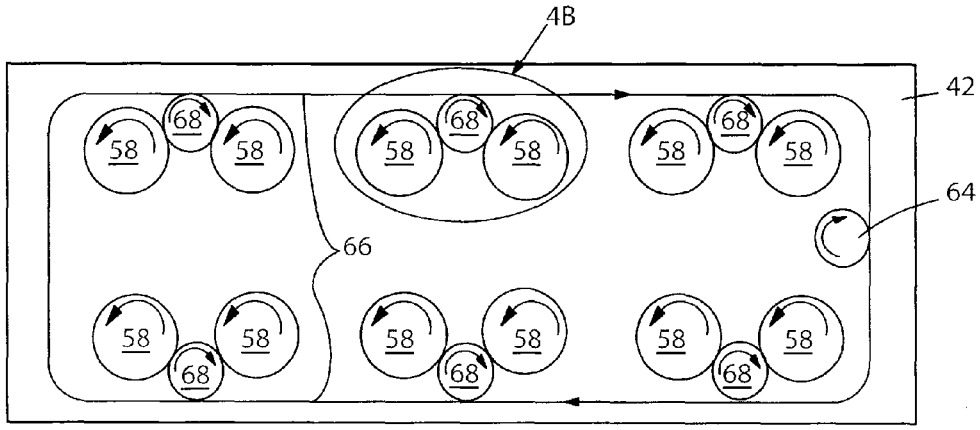
FIG. 4A depicts an exemplary schematic diagram of a drive belt arrangement for rotating the carriers of the machine of FIG. 3.
Figure 4B:
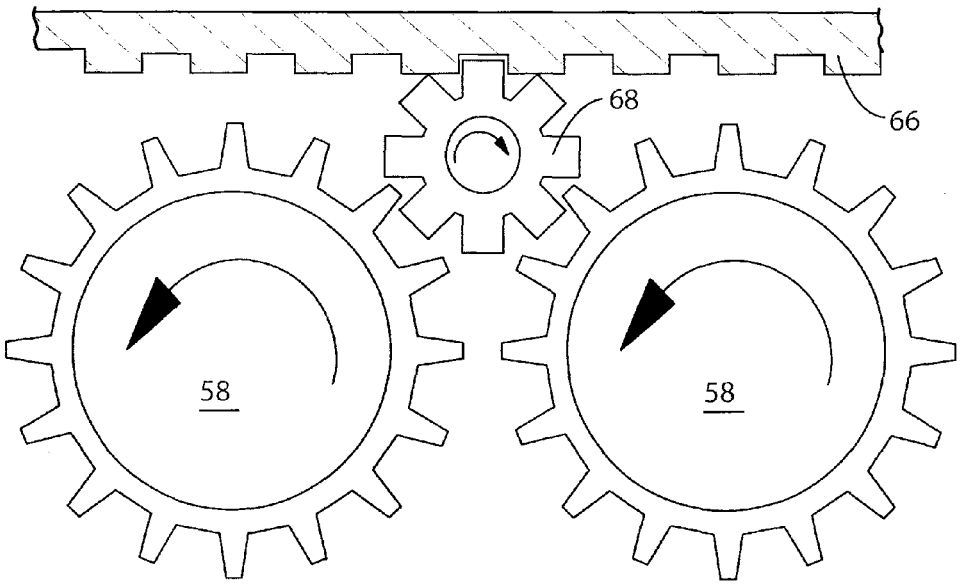
FIG. 4B depicts a detailed view of the drive belt arrangement of FIG. 4A depicting the engagement between the belt, the carriers, and the drive gear.

FIG. 4A depicts an exemplary schematic diagram of a drive belt arrangement for rotating the work-piece carriers 58 about their respective longitudinal axes. FIG. 4B depicts a detailed view of the drive belt arrangement of FIG. 4A. The drive belt arrangement comprises a motor having a rotating output shaft 64, a toothed belt 66 that is in toothed engagement with gears of the output shaft 64, a series of drive gears 68 that are in toothed engagement with both the belt 66 and the work-piece carriers 58. At least a portion of each carrier 58 includes teeth for engaging teeth of a drive gear 68.

In operation, rotation of the output shaft 64 in a first rotational direction causes rotation of the belt 66 in the first direction, which causes rotation of the drive gears 68 in the first direction, which causes rotation of the carriers 58 in a second rotational direction that is opposite to the first rotational direction (as depicted by the arrows). Those skilled in the art will recognize other ways to rotate the carriers 58 that do not depart from the scope or spirit of the invention.

Turning now to the components of the second platform 46 of FIGS. 2 and 3, the second platform 46 includes a housing 62, a plurality of tools 50 rotatably mounted within the housing 62, means for rotating each of the tools 50 about their respective longitudinal axes, and a fluid distribution network 64.

Each tool 50 is equivalent to tool 10, tool 30, tool 31 or tool 35 of FIGS. 1A-1D, respectively. Each tool 50 corresponds in position to a work-piece receiving area 44 of the first platform 42. As described with reference to FIG. 1A, the axis of rotation of each tool 50 is oriented at an oblique angle or offset from with respect to a longitudinal axis of a corresponding work-piece receiving area 44 of the first platform 42. By way of non-limiting example, twelve tools 50 are rotatably mounted within the housing 62. Although not shown, as described with reference to FIG. 10, the axis of rotation of each tool 50 may be laterally offset from a longitudinal axis of a corresponding work-piece receiving area 44 of the first platform 42.

The fluid distribution network 64 is a series of interconnected tubes that are positioned to deliver fluid to the apertures (see item 20 of FIG. 1A) that are formed in each of the tools 50 (as described with reference to FIG. 1A). Although not shown, a pump delivers fluid through the fluid distribution network 64. The second platform 46 also includes means for rotating each of the tools 50, as will be discussed hereinafter.

Figure 5:
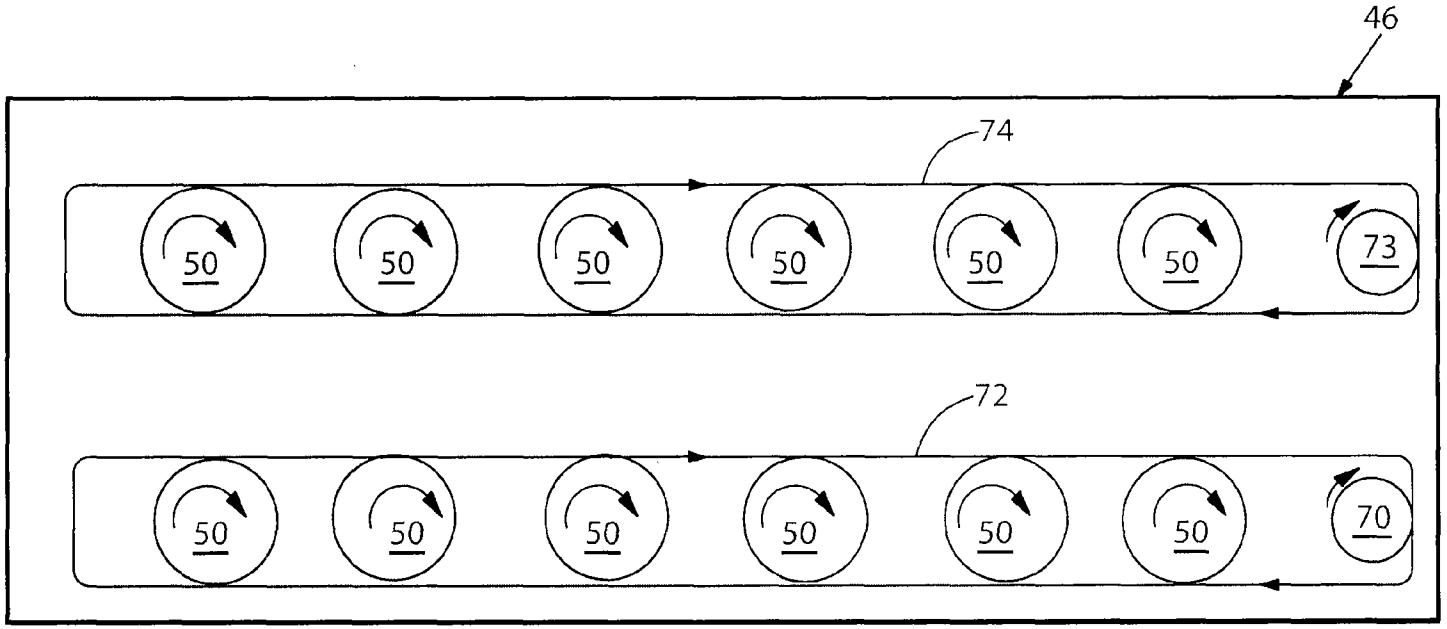
FIG. 5 depicts an exemplary schematic diagram of a drive belt arrangement for rotating the tools of the machine of FIG. 3.

FIG. 5 depicts an exemplary schematic diagram of a drive belt arrangement for rotating the tools 50 about their respective longitudinal axes. The drive belt arrangement comprises a first motor having a rotating output shaft 70, one toothed belt 72 that encircles and is in toothed engagement with the gears of the output shaft 70 the gears of six tools 50 that are positioned in a first row. The drive belt arrangement also includes a second motor having a rotating output shaft 73, and another toothed belt 74 that encircles and is in toothed engagement with the gears of the output shaft 73 and six other tools 50 that are positioned in a second row.

In operation, rotation of the output shaft 70 in a first rotational direction causes rotation of the belt 72 in the first direction, which causes rotation of the tools 50 of the first row in the first direction (as shown by the arrows). Similarly, rotation of the output shaft 73 in a first rotational direction causes rotation of the belt 74 in the first direction, which causes rotation of the tools 50 of the second row in the first direction (as shown by the arrows). Although not shown, the motor 73 and the belt 74 may be omitted if the belt 72 encircles all of the tools 50. Those skilled in the art will recognize other ways exist to rotate the tools 50 that do not depart from the scope or spirit of the invention.

Referring now to the operation of the machine 40, the second platform 46 is raised by the press 52 to separate the second platform 46 from the first platform 42. One or more work-pieces 12 are positioned in the work-piece receiving areas 44 of the tray 54. The tray 54 is then positioned on the housing 43 of the first platform 42, unless the tray 54 is already positioned on the housing 43 or the tray 54 is integrated with the housing 43. Upon mounting the tray 54 to the housing 43, the lower ends of the work-pieces 12 are seated within the recesses formed in the carriers 58.

The second platform 46 is then lowered by the press 52 to bring the second platform 46 adjacent to the first platform 42, thereby positioning the abrasive pad of each tool 50 in contact with the top edge of the corresponding work-piece 12. As described previously, the axis of rotation of the tool 50 is pre-oriented at an oblique angle with respect to a longitudinal axis of the work-piece 12 and a longitudinal axis of the carrier 58. The tools 50 are then simultaneously rotated in a first rotational direction and the carriers 58 are simultaneously rotated in a rotational direction that is opposite the first direction, thereby forming a radius surface on the top edge of each work-piece 12. Once the radius surfaces are formed on the top edge of each work-piece 12, the second platform 46 is raised by the press 52 to separate the second platform 46 from the first platform 42. The one or more work-pieces 12 are then unloaded from the tray 54.

Although the invention is illustrated and described herein with reference to specific embodiments, the invention is not intended to be limited to the details shown. Rather, various modifications may be made in the details within the scope and range of equivalents of the claims and without departing from the invention. For example, it should be understood that this invention is not limited to cylindrically-shaped work-pieces. If the work-piece does not include a longitudinal axis, a tool may be mounted such that an axis of rotation of the tool is oriented at an oblique angle with respect to any surface of the work-piece.

What is claimed:

1. A machine for simultaneously forming a concave or convex radius surface on a plurality of work-pieces comprising:

a first platform including a plurality of work-piece receiving areas that are each configured to accommodate a work-piece; and a second platform positioned adjacent the first platform, the second platform including a plurality of substantially hollow rotatable tools each of which includes a circumferential surface that is configured for forming or polishing a radius surface on a work-piece, wherein each hollow rotatable tool corresponds in position to a work-piece receiving area of the first platform;

wherein an axis of rotation of each tool is oriented at an oblique angle with respect to a longitudinal axis of a corresponding work-piece and a longitudinal axis of a corresponding work-piece receiving area;

a press is included for translating the second platform with respect to the first platform, or vice versa;

the first platform includes a removable tray positioned on top of a housing for accommodating the work pieces, the removable tray includes the plurality of work-piece receiving areas that are each configured to accommodate a single work piece, the removable tray includes a top surface and a series of through-holes defined on the top surface, each through-hole sized to receive a work piece, each work piece receiving area corresponds in position to one of the rotatable tools of the second platform, the first platform includes a plurality of rotatable carriers, each rotatable carrier configured to rotate a respective work piece, when the respective work piece is positioned in the removable tray, the first platform includes means for simultaneously rotating all the rotatable carriers in a first direction, and the second platform includes means for simultaneously rotating all the rotatable tools in a second direction, opposite to the first direction; and wherein the work pieces are configured to be positioned in the removable tray, and the removable tray is configured to be positioned on top of the housing and in position for rotation by the rotatable carriers, and the means for rotation are configured to simultaneously rotate all the rotatable carriers in the first direction and all the rotatable tools in the second direction.

2. The machine of claim 1 wherein an aperture is defined in each hollow rotatable tool through which a fluid is delivered to facilitate forming, grinding or polishing of the work-piece.

3. The machine of claim 2 further comprising a network of fluid delivery conduits for delivering fluid to the apertures in the rotatable tools.

4. The machine of claim 1, wherein the work-piece rotating means comprises a motor-driven drive belt that is configured to either directly or indirectly rotate a plurality of carriers that are each positioned in the first platform, wherein each carrier is configured to support a work-piece such that rotation of a particular carrier induces rotation of the work-piece that is supported by that particular carrier.

5. The machine of claim 1, wherein the tool rotating means comprises a motor-driven drive belt that is configured to either directly or indirectly rotate the tools.

6. A method of forming a concave or convex radius surface on each of a plurality of work-pieces comprising the steps of:

positioning multiple work-pieces in or on multiple carriers, respectively, in which the multiple work-pieces are placed in multiple holes of a removable tray and the multiple holes are aligned with the multiple carriers;

positioning an abrasive surface of a substantially hollow rotatable tool adjacent each of the plurality of work-pieces such that an axis of rotation of each tool is oriented at an oblique angle with respect to a longitudinal axis of a respective work-piece and a longitudinal axis of a respective carrier of a work-piece;

simultaneously rotating all the hollow rotatable tools in a first rotational direction; and simultaneously rotating all the carriers in a rotational direction that is opposite to the first rotational direction to form a radius surface on an axial end of each work-piece.

7. The method of claim 6, wherein the tool positioning step includes positioning an abrasive surface of a plurality of rotatable tools adjacent corresponding work-pieces such that an axis of rotation of each tool is oriented at an oblique angle with respect to a longitudinal axis of a corresponding work-piece and a longitudinal axis of a corresponding carrier.

* * * * *